US006969229B2

(12) United States Patent
Beccaluva et al.

(10) Patent No.: US 6,969,229 B2
(45) Date of Patent: Nov. 29, 2005

(54) SEALING SYSTEM FOR CENTRIFUGAL COMPRESSORS WHICH PROCESS LETHAL GASES

(75) Inventors: Riccardo Beccaluva, Limite Sull'Arno (IT); Stefano Mantellassi, Lamporecchio (IT); Antonio Pumo, Florence (IT)

(73) Assignee: Nuovo Pignone Holding S.p.A., Florence (IT)

( * ) Notice: Subject to any disclaimer, the term of this patent is extended or adjusted under 35 U.S.C. 154(b) by 0 days.

(21) Appl. No.: 10/452,923

(22) Filed: Jun. 3, 2003

(65) Prior Publication Data

US 2003/0231954 A1 Dec. 18, 2003

(30) Foreign Application Priority Data

Jun. 5, 2002 (IT) ..... MI2002A001222

(51) Int. Cl.[7] ..... F01D 11/00

(52) U.S. Cl. ..... 415/112; 415/168.2

(58) Field of Search ..... 415/1, 112, 168.1, 415/168.2, 168.4, 109, 110, 111, 113, 229, 415/230, 231

(56) References Cited

U.S. PATENT DOCUMENTS

2002/0031437 A1 * 3/2002 Jean ..... 417/423.11

* cited by examiner

*Primary Examiner*—Edward K. Look
*Assistant Examiner*—Richard A. Edgar
(74) *Attorney, Agent, or Firm*—Nixon & Vanderhye, P.C.

(57) ABSTRACT

A sealing system (10) which ensures the safe operation of very high pressure centrifugal compressors which process lethal gases. The system comprises sealing means (18, 19) separated by an annular chamber (12), and a discharge line (32) for collecting and eliminating any gases that may be released.

4 Claims, 1 Drawing Sheet

Figure 1:
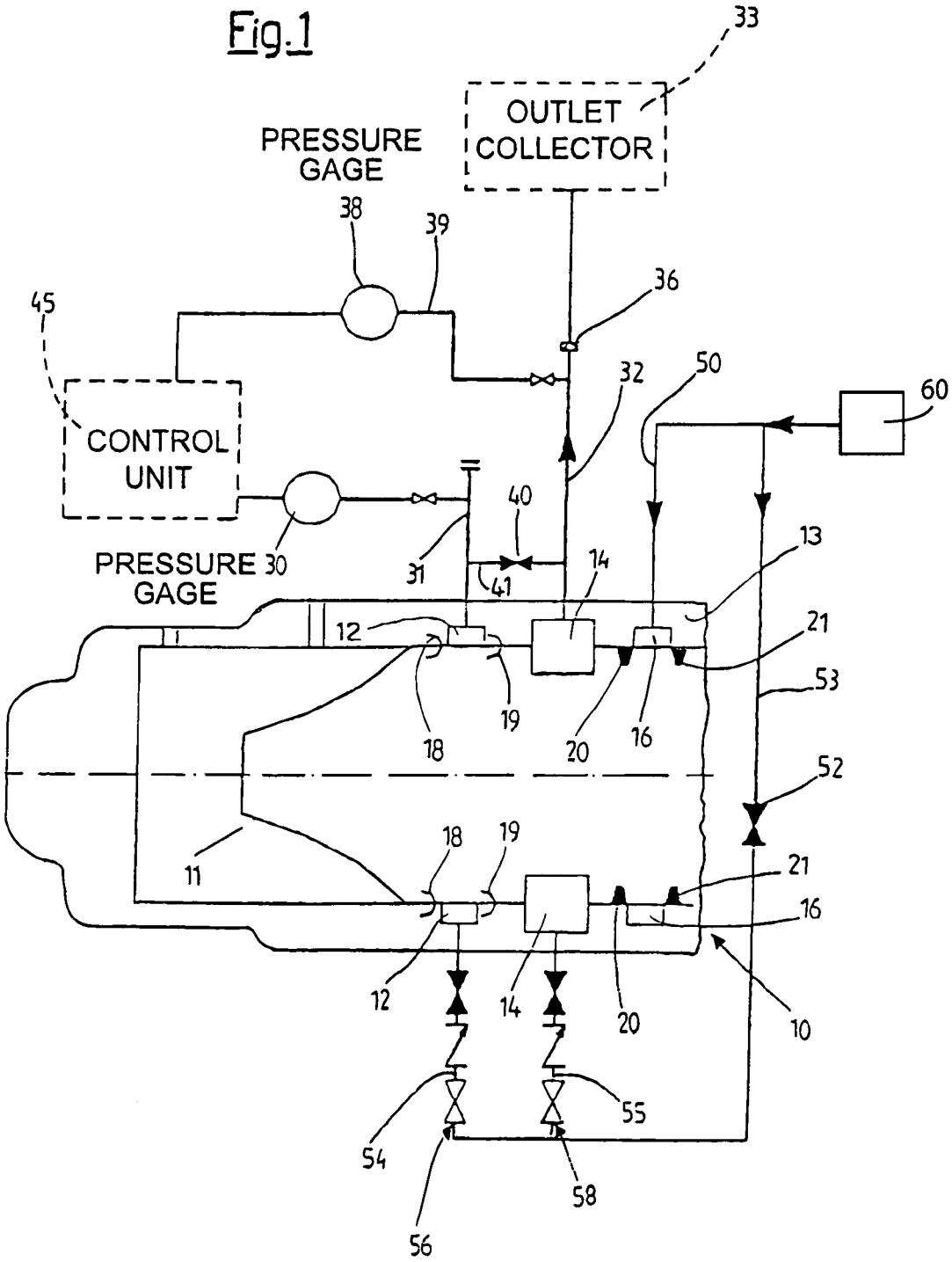

OUTLET COLLECTOR
PRESSURE GAGE
CONTROL UNIT
PRESSURE GAGE
33
38
39
36
45
32
50
60
40
30
31
41
14
13
12
21
53
18
19
20
16
52
11
18
19
21
16
12
14
20
10
55
54
58
56

SEALING SYSTEM FOR CENTRIFUGAL COMPRESSORS WHICH PROCESS LETHAL GASES

The present invention relates to a sealing system for centrifugal compressors which process lethal gases.

As is known, a centrifugal compressor is a machine into which a compressible fluid is introduced, this fluid being emitted at a pressure greater than its pressure on entry.

A centrifugal compressor can have one or more stages, and can be used for medium and/or high pressures.

One typical application of centrifugal compressors is to the reinjection of natural gas.

For example, the centrifugal reinjection compressors produced by the General Electric Oil & Gas—Nuovo Pignone company are characterized by delivery pressures of up to 600 bar, and frequently by the presence in the process gas of contaminants which are highly lethal even at low concentrations. By way of example hydrogen sulphide ($H_2S$), may be mentioned, an acid gas which is lethal if present in concentrations of more than 1%.

Up to the present time no structured solution has ever been devised for minimizing the leaks of process gas, which would be extremely dangerous to the safety of personnel working in the plant and of the environment.

The object of the present invention is therefore to resolve the aforementioned technical problem and in particular the problem of providing a sealing system for centrifugal compressors which process lethal gases which enables the processed gas to be contained and controlled in order to minimize the leaks of gas and the accumulation of harmful gas in the interstices between the casing of a compressor and its end flange.

Another object of the present invention is to provide a sealing system for centrifugal compressors which process lethal gases which enables the acid gas to be totally eliminated from the end caps of a compressor, to allow maintenance operations to be carried out on the compressor in complete safety.

A further object of the present invention is to provide a sealing system for centrifugal compressors which process lethal gases which is characterized by maximum simplicity and robustness in order to provide reliability at a modest cost.

These and other objects of the present invention are achieved by providing a sealing system as described in Claim 1 for centrifugal compressors which process lethal gases.

Further characteristics are specified in the subsequent claims.

The characteristics and advantages of the sealing system according to the invention for centrifugal compressors which process lethal gases will be made clearer and more evident by the following description, provided by way of example and without restrictive intent, with reference to the attached sheet of schematic drawing, in which:

FIG. 1 shows a diagram of the sealing system according to the invention for centrifugal compressors which process lethal gases.

With reference to the figure, what is shown is a sealing system, indicated as a whole by the number 10 and located between a casing 13 and an end flange 11 of a centrifugal compressor which processes a lethal gas.

In the illustrated example, according to the present invention, the sealing system 10 comprises three annular chambers 12, 14 and 16 arranged in series.

A first annular chamber 12 is located between a sealing means such as an inner lip seal 18, exposed to the inlet pressure of the compressor, and a further sealing means such as an outer lip seal 19.

A second annular chamber 14 is located between this outer lip seal 19 and an inner ring gasket 20.

A third annular chamber 16 is located between this inner ring gasket 20 and an outer ring gasket 21.

The first annular chamber 12 is connected to a first pressure gauge 30 by a first line 31.

The second annular chamber 14 is connected to a discharge line 32, terminating in a low-pressure outlet collector 33.

The discharge line 32 has an orifice 36. A second line 39 for a second pressure gauge 38 is connected to the discharge line 32 upstream of the orifice 36.

Upstream of the connection of the second line 39, the discharge line 32 is connected to the first line 31 by a third line 41 having a shut-off valve 40.

The third annular chamber 16 is supplied with inert gas such as nitrogen from a first line 50 in communication with a nitrogen reservoir 60 The first annular chamber 12 and the second annular chamber 14 can be supplied with inert gas through a second line 53 when a second shut-off valve 52 is operated.

More precisely, the second pressurized line 53 branches into a first section 54 and a second section 55, connected respectively to the first chamber 12 and to the second chamber 14, and having a first valve 56 and a second valve 58.

The operation of the sealing system 10 that has been described varies according to whether the compressor is operating normally or is under maintenance.

During the normal operation of the compressor, the valves 40 and 52 are closed.

The main sealing action is provided by the inner lip seal 18, designed to oppose the pressure difference between the compressor intake and atmospheric pressure.

However, during the pressurization of the compressor before starting, the low pressures do not permit optimal operation of the seal 18, and consequently there is a small leakage of gas which passes through the first annular chamber 12 into the second annular chamber 14.

This flow of gas is created because the outer lip seal 19, connected through the discharge line 32 to the outlet collector 33, is at a lower pressure than that to which the inner lip seal 18 is subjected.

In practice, in normal operation, the leakage of gas is directed into the discharge line 32, and flows out into the outlet collector 33.

To ensure that the whole of the gas leakage is correctly directed into the outlet collector 33 in all operating conditions, preventing the emission of gas into the atmosphere, a third annular chamber 16 is provided, this chamber being pressurized, generally with nitrogen.

The nitrogen is supplied from the first pressurized line 50 at a relative pressure of 1 bar. Since the outlet collector 33 is normally at a relative pressure of 0.1 bar, or 0.5 bar at the most, the acid gas is completely isolated from the atmosphere.

The pressure gauges 30 and 38 signal the pressures of the chambers 12 and 14 respectively.

If the inner lip seal 18 is damaged, the first pressure gauge 30 detects a rapid rise in pressure. If this pressure is too high, the first gauge 30 sends an instruction to a control unit 45 of the centrifugal compressor, which stops the compressor.

During the compressor shutdown and depressurization transient, the outer lip seal 19, which has the same dimensions as the inner lip seal 18, acts as the main seal.

Additionally, the second pressure gauge 38 can detect any simultaneous damage of both lip seals 18 and 19, which results in a safety shutdown of the compressor.

In this case, the orifice 36 allows a flow of acid gas to pass out, thus protecting the outlet collector 33 and the equipment downstream of the discharge line 32, which is designed for low pressures.

In the maintenance phase, the sealing system 10 enables safe conditions to be ensured during the dismantling of the centrifugal compressor.

Before the end flange 11 of the compressor is removed, it is essential to remove any lethal gas remaining trapped within the annular chambers 12, 14 and 16.

When the shut-off valve 52, the first valve 56 and the second valve 58 are initially opened, the chambers 12 and 14 are supplied with nitrogen at a relative pressure of approximately 1 bar through the second line 53, the first line 54 and the second section 55.

When the shut-off valve 40 is also opened, the nitrogen flows into the first annular chamber 12 and into the second annular chamber 14, thus removing any lethal gas which may be present.

It should also be noted that, when the end flanges 11 of the compressor have been dismounted, the inner lip seal 18 and outer lip seal 19 must be placed in a safe area to avoid toxic contamination due to the acid and lethal gases trapped in the material from which they are made.

It must also be pointed out that the low-pressure outlet collector 33 can be preceded by a device, such as a flare system, for burning the acid gases which arrive from the discharge line 32.

The above description makes clear the characteristics of the sealing system according to the invention for centrifugal compressors which process lethal gases, and also makes clear its advantages, among which may be mentioned:

the reliable containment, with continuous monitoring of the operating conditions of the lip seal 18;

the guarantee of complete flushing of the areas exposed to harmful gas, allowing maintenance operations to be carried out in safe conditions by the operators;

the low cost by comparison with the prior art.

Finally, it is clear that the sealing system for centrifugal compressors which process lethal gases, designed as stated above, can be modified and varied in numerous ways without departure from the invention; moreover, all the components can be replaced with technically equivalent elements. In practice, the materials used, and the shapes and dimensions, can be chosen at will, subject to technical requirements.

The scope of protection of the invention is thus delimited by the attached claims.

What is claimed is:

1. A sealing system for a centrifugal compressor for processing lethal gases comprising:

a compressor casing, a first annular chamber connected to a discharge line terminating in a low pressure outlet collector, sealing means being interposed between the compressor casing and an end flange of the casing including an inner lip seal and an outer lip seal, a second annular chamber between said inner lip seal and said outer lip seal, a third annular chamber upstream of said annular chamber, said third annular chamber being located between an inner ring gasket and an outer ring gasket, a first inert gas line for supplying pressurized inert gas to said third annular chamber, a second inert gas line having a shut-off valve therein for supplying pressurized inert gas to said first and second chambers in response to opening said shut off valve, a first line interconnecting said second annular chamber and a first pressure gauge, a second line connected to said discharge line and interconnecting said first annular chamber and a second pressure gauge, said discharge line being connected upstream of said second line to said first line by a third line having a shut off valve, a control unit for controlling the compressor and connected to said first and second pressure gauges, said control unit being responsive to a rapid rise of pressure detected by said first pressure gauge to cause the compressor to shut down and responsive to a rapid rise of pressure detected by said second pressure gauge to cause the compressor to be shut down.

2. A sealing system according to claim 1 wherein said second pressurized line has first and second sections connected respectively to said second annular chamber and to said first annular chamber, first and second valves in said first and second sections.

3. A sealing system according to claim 1 wherein said discharge line includes an orifice enabling outflow of gas in response to failure of the inner and outer lip seals.

4. A sealing system according to claim 1 wherein the gas processed in said centrifugal compressor is an acid gas with a content of hydrogen sulfide in excess of 1%.

* * * * *